United States Patent [19]

Muramoto et al.

[11] 4,088,984

[45] May 9, 1978

[54] FLAME DETECTION

[75] Inventors: Shoichi Muramoto; Susumu Nishigaki, both of Tokyo, Japan

[73] Assignee: Sony Corporation, Tokyo, Japan

[21] Appl. No.: 687,467

[22] Filed: May 18, 1976

[30] Foreign Application Priority Data

May 28, 1975 Japan ..... 50-64663

[51] Int. Cl.[2] ..... G08B 17/06

[52] U.S. Cl. ..... 340/228 R; 431/78; 340/222; 340/419

[58] Field of Search ..... 340/228 R, 228.1, 222, 340/419; 328/6; 431/25, 59, 70, 78, 79, 80; 307/310

[56] References Cited

U.S. PATENT DOCUMENTS

| | | | |
|---|---|---|---|
| 3,627,458 | 12/1971 | Wade | 328/6 X |
| 3,671,815 | 6/1972 | Eberle et al. | 340/228.1 X |
| 3,836,857 | 9/1974 | Ikegami et al. | 340/228.1 X |
| 3,986,813 | 10/1976 | Hewitt | 431/80 |

*Primary Examiner*—Glen R. Swann, III

*Attorney, Agent, or Firm*—Hill, Gross, Simpson, Van Santen, Steadman, Chiara & Simpson

[57] ABSTRACT

A flame detecting apparatus in which a detecting electrode is disposed in a flame, the base of a transistor is connected to the detecting electrode and biased with a predetermined DC voltage derived from a biasing circuit, the biasing circuit including a resistor and the impedance of the flame, an AC signal is applied to the emitter of the transistor, and an amplified AC signal is derived from the collector of the transistor as an output signal; the output signal being used as a control signal for a fuel supply control and/or an indicator.

6 Claims, 4 Drawing Figures

FLAME DETECTION

BACKGROUND OF THE INVENTION

1. Field of the Invention

This invention relates to flame detecting apparatus.

2. Description of the Prior Art

In general, known flame detecting apparatus exploiting the electric conductivity or rectification action of a flame requires a voltage of several hundred volts to be applied between an electrode disposed in the flame position and a burner. If then a flame is present, current flows between the electrode and the burner and is amplified by an amplifier circuit of high input impedance, which employs a field-effect transistor or the like, the amplified output signal being used as a control signal to control the supply of fuel to the burner. Since, however, the impedance of the flame is very large, the current flowing in the flame is minute, and it is therefore difficult to obtain a stable control signal, or it is necessary to use a complex amplifier having a very high gain.

SUMMARY OF THE INVENTION

It is accordingly an object of the invention to provide a flame detecting apparatus which is free from the disadvantages of the known apparatus described above.

Another object of the invention is to provide a flame detecting apparatus in which the impedance of a flame is utilized as part of a biasing circuit connected to a base of an amplifying transistor, the emitter of which is supplied with an AC signal.

Still another object of the invention is to provide a flame detecting apparatus in which a detecting electrode disposed in a flame and connected to the base of amplifying transistor is biased with a positive DC potential, and an auxiliary electrode also disposed in the flame is biased with relatively low DC potential relative to the detecting electrode.

Still another object of the invention is to provide a flame detecting apparatus using junction transistors for amplifying, instead of field-effect transistors.

Yet another object of the invention is to provide a flame detecting apparatus using simple, solid-state circuitry, and not requiring a high voltage for its operation.

BRIEF DESCRIPTION OF THE DRAWINGS

Further objects, features and advantages of the invention will become apparent from the following description given by way of example, with reference to the accompanying drawings, in which.

DESCRIPTION OF THE PREFERRED EMBODIMENTS

Figure 1:
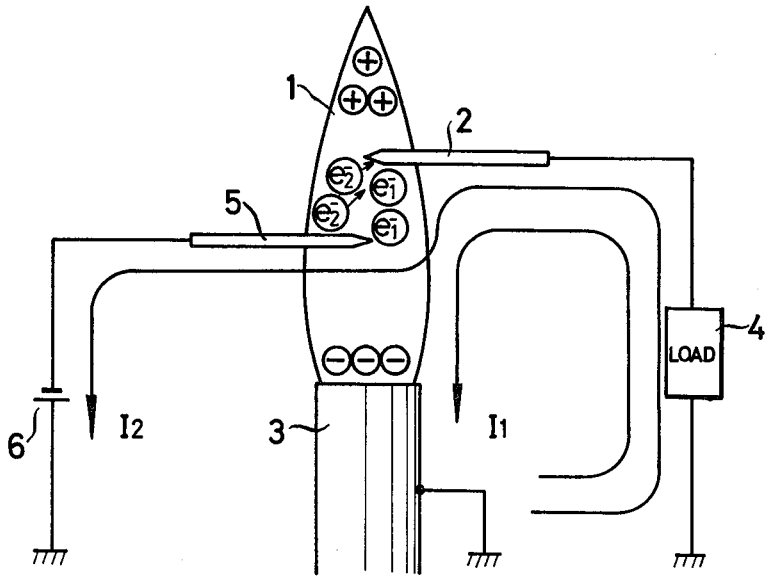
FIG. 1 illustrates diagrammatically a flame detecting apparatus, and is used for explaining the basic principles of the invention.

Referring now to the drawings, FIG. 1 illustrates a flame detecting apparatus diagrammatically and is used to explain the invention. A detecting electrode 2 is disposed in a flame 1 from a grounded burner 3. An auxiliary electrode 5 is positioned under the detecting electrode 2 so as also to be disposed in the flame 1. The DC potential of the detecting electrode 2 is higher than that of the auxiliary electrode 5, the auxiliary electrode 5 being biased to a negative potential by a DC voltage source 6. A load 4 is connected between the electrode 2 and ground.

Some of the atoms or molecules in the flame 1 are thermally ionized by the high temperature, so there are many positive ions of $H_3O^+$ which have lost electrons, in the top region of the flame 1, and many negative ions of $HO^-$ in the bottom region of the flame 1. Also, there are many electrons $e_1^-$ produced by the thermal ionization in the middle region of the flame 1. The electrons $e_1^-$ are caught by the detecting electrode 2, so that a current $I_1$ flows through the flame 1 from the electrode 2 to the burner 3, which means that the detecting electrode 2 is charged to a negative potential. Also, since the auxiliary electrode 5 is substantially heated by the flame 1, many thermal electrons $e_2^-$ are discharged therefrom, and are caught by the detecting electrode 2. Thus, a second current $I_2$ flows through the flame 1 from the detecting electrode 2 to the auxiliary electrode 5, so the electrode 2 is still further charged to a negative potential. When $-30V$ is applied to the auxiliary electrode 5, the detected voltage and current are $-17V$ and $17\mu A$, respectively.

Thus, if an auxiliary electrode biased with a negative potential relative to the detecting electrode is positioned under the detecting electrode, a relatively large voltage or current is detected. This means in effect that the impedance of the flame 1 is reduced.

Figure 2:
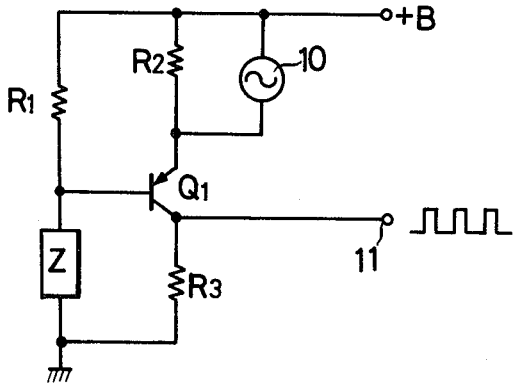
FIG. 2 shows a simplified equivalent circuit of the apparatus of FIG. 1.

FIG. 2 is a circuit diagram illustrating the principle of a flame detecting apparatus according to this invention. The circuit comprises an impedance Z of a flame, which is connected in series with a resistor $R_1$. The series circuit formed by the resisitor $R_1$ and the impedance Z of the flame is connected between a DC power source +B and ground, and forms a base biasing circuit for a transistor $Q_1$, the base of which is connected to the junction between the resistor $R_1$ and the impedance Z. An emitter resistor $R_2$ is connected between DC power source +B and the emitter of transistor $Q_1$, and a collector resistor $R_3$ is connected to the collector of transistor $Q_1$. An AC signal source 10 is connected to the emitter, and an output terminal 11 is connected to the collector of transistor $Q_1$.

With this circuit, if a flame exists, a current flows through the resistor $R_1$ and the impedance Z of the flame, and a predetermined DC potential appears at the junction between the resistor $R_1$ and the impedance Z, this DC potential being selected such that the transistor $Q_1$ is made conductive or "on." If the transistor $Q_1$ is in the "on" state, the AC signal applied to the emitter is amplified by the transistor $Q_1$ and supplied to the output terminal 11. However, if the flame goes out, the impedance Z suddenly increases, the transistor $Q_1$ is brought from the "on" state into the "off" state, and no signal is supplied to the output terminal 11. Thus, it is possible to detect the flame. Of course, if the impedance Z becomes negligibly small, for example, because the detecting electrode is shorted to the burner or to the auxiliary electrode; no output signal is supplied to the output terminal 11, because the transistor $Q_1$ is saturated.

Figure 3:
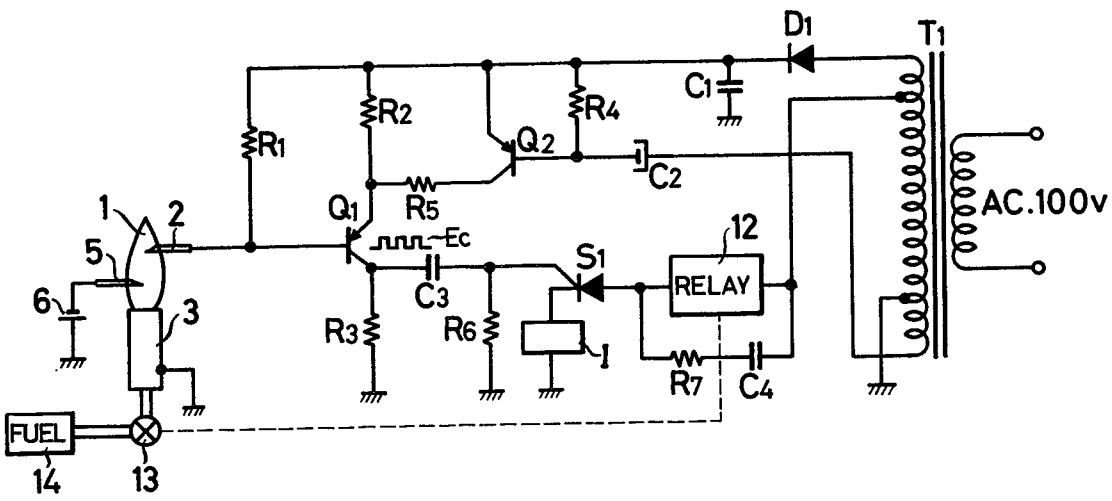
FIGS. 3 and 4 are respective circuit diagrams of first and second embodiments of flame detecting apparatus according to the invention.

FIG. 3 shows a circuit diagram of a first embodiment of the present invention. In this circuit, 100V AC is supplied to the primary winding of a transformer $T_1$, and a predetermined low DC voltage is applied to the detecting electrode 2 disposed in a flame 1 through a rectifying and smoothing circuit comprising a diode $D_1$, a capacitor $C_1$ and a resistor $R_1$. The predetermined DC voltage is also applied to transistors $Q_1$ and $Q_2$ as operating voltages. The base of the transistor $Q_2$ is connected to one end of the secondary winding of the transformer $T_1$ through a coupling capacitor $C_2$, so that an AC signal is applied to the base of transistor $Q_2$. The transformer $T_1$ thus forms an AC signal source, and the AC signal is amplified by the transistor $Q_2$. When the flame 1 is present, then, since a suitable base biasing voltage is supplied to the base of transistor $Q_1$, the transistor $Q_1$ is "on" as described above, so that the AC signal is amplified and appears at the collector thereof as a pulse-like control signal Ec. This control signal Ec is fed as a switching signal to the gate of a silicon controlled rectifier (SCR) $S_1$, which forms a switching element, through a capacitor $C_3$. A relay 12 forming a control means, is connected between transformer $T_1$ and the SCR $S_1$, and is energized when the SCR $S_1$ is the "on" state. The relay 12 controls a fuel supply valve 13. When the relay 12 is energized, the valve 13 is open, so that fuel form fuel supply 14 is supplied to the burner 3. If, however, the flame 1 goes out, the transistor $Q_1$ is brought from the "on" state to "off" state, because the impedance between the detecting electrode 2, and hence between the base of transistor $Q_1$, and the burner 3 becomes substantially infinite. Therefore, the control signal Ec does not appear at the collector of transistor $Q_1$, the relay 12 is de-energized, and the valve 13 is closed. That is, fuel is not supplied to the burner 3, and safety is maintained.

The circuit further comprises resistors $R_2$ to $R_7$ and a capacitor $C_4$, but further description will be omitted for brevity.

As shown, auxiliary electrode 5 is disposed under the detecting electrode 2 in the flame 1 and is connected to a negative voltage source 6. However, as the detecting electrode 2 is biased with a positive potential, the auxiliary electrode 5 may be omitted. Nevertheless, it is preferable to provide the auxiliary electrode 5, as it improves the sensitivity of the apparatus. Moreover, the SCR $S_1$ may be replaced by a conventional transistor.

Figure 4:
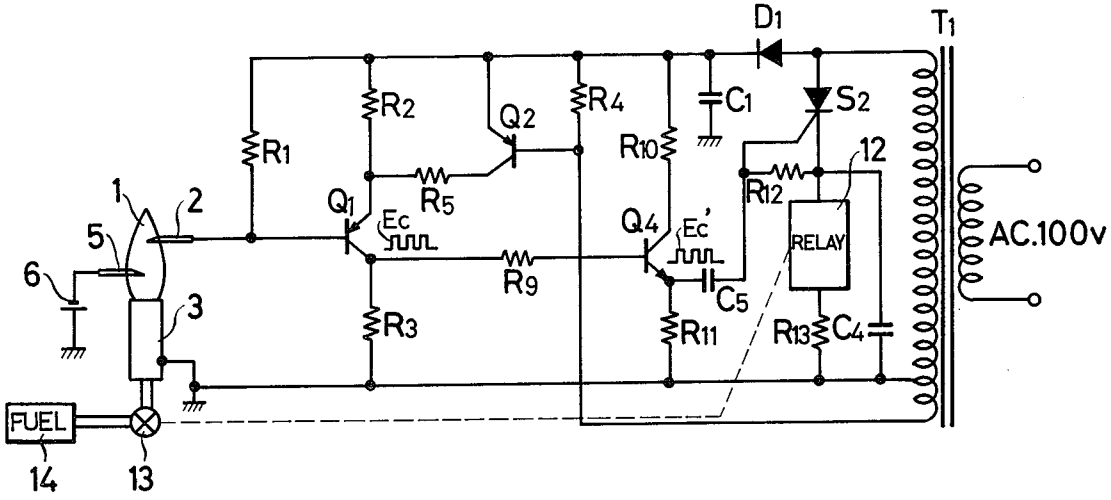

FIG. 4, to which reference is now made, shows a circuit diagram of a second embodiment of the present invention. In this circuit, in which elements similar to those in FIG. 3 have the same references and will not be further described, an emitter-follower stage comprising a transistor $Q_4$ is connected to the collector of the transistor $Q_1$, and the output of the emitter-follower stage is supplied to the gate of an SCR $S_2$ through a capacitor $C_5$. In this embodiment, since the transistor $Q_1$ is in common-base configuration, its output impedance is high, but this is converted to a low impedance by the emitter-follower transistor $Q_4$. The circuit further comprises resistors $R_9$ to $R_{13}$ and capacitor $C_5$, further description of which will be omitted for brevity.

If required, an indicator I may be provided to indicate the presence or absence of the flame 1. In the embodiment of FIG. 3 the indicator I is interposed between the cathode of the SCR $S_1$ and ground, and in the embodiment of FIG. 4 it would replace the resistor $R_{11}$.

The invention can be used in gas-fired burner installations, but can of course be used with flames produced by other fuels.

Moreover, other modifications and variations will be apparent to those skilled in the art and are included in the scope of the invention which is defined by the appended claims.

We claim:

1. Flame detecting apparatus comprising:

a detecting electrode disposed in a flame position;

a burner for producing a flame in said flame position, the impedance between said burner and said detecting electrode depending on whether a flame is present in said flame position;

an active element having input, output and control electrodes and having an "on" condition and an "off" condition;

an AC power source;

a transformer having an input winding connected to said AC power source, and an output winding;

said output winding of said transformer providing an AC signal source for supplying an AC signal to the input electrode of said active element, whereby an amplified AC signal is derived from the output electrode of said active element when said active element is in the "on" condition;

a DC biasing source including rectifier means and connected to said output winding of said transformer, said biasing source being connected in series with said impedance for supplying a control signal to the control electrode of said active element, the control signal being such that said active element is in the "on" condition when a flame is present in said flame position;

wherein said rectifier means includes a resistor connected between said AC signal source and said detecting electrode, and said detecting electrode is connected to the control electrode of said active element;

a switching element connected to the output electrode of said active element, a control device connected to said switching element; and a fuel supply control means controlled by said control device to supply fuel to said burner when a flame is present in said flame position.

2. Apparatus accroding to claim 1, further comprising an indicator connected to the output electrode of said active element for indicating whether a flame is present in said flame position.

3. Apparatus according to claim 1, wherein said active element is a transistor in common-base configuration.

4. Apparatus according to claim 3, further comprising a second transistor having an input electrode connected to said rectifier means, an output electrode connected to said first transistor, and a control electrode connected to said output winding.

5. Apparatus according to claim 3, further comprising an emitter-follower stage connected to the output electrode of said first transistor.

6. Apparatus according to claim 1, further including an auxiliary electrode mounted in said flame position and means for supplying said auxiliary electrode with a low DC potential relative to said detecting electrode, said auxiliary electrode being disposed between the detecting electrode and said burner being grounded.

* * * * *